US005496206A

United States Patent [19]

Young

[11] Patent Number: 5,496,206

[45] Date of Patent: Mar. 5, 1996

[54] BUILDING BLOCK FACE ENHANCEMENT APPARATUS

[76] Inventor: Thomas D. Young, 3235 W. Greenridge Dr., Tucson, Ariz. 85741

[21] Appl. No.: 338,338

[22] Filed: Nov. 14, 1994

[51] Int. Cl.[6] ..... B24B 7/06; B28D 1/24

[52] U.S. Cl. ..... 451/260; 451/262; 125/26

[58] Field of Search ..... 451/41, 177, 178, 451/182, 184, 190, 194, 195, 259, 260, 261, 262, 296, 299, 300, 302, 336; 125/26

[56] References Cited

U.S. PATENT DOCUMENTS

| | | | |
|---|---|---|---|
| 1,915,751 | 6/1933 | Noble et al. | 125/26 |
| 2,732,590 | 1/1956 | Le Clercq | 451/260 |
| 2,884,921 | 5/1959 | Drake | 125/26 |
| 2,901,868 | 9/1959 | Price et al. | 125/26 |
| 2,958,163 | 11/1960 | Cammerzell, Jr. | 125/26 |
| 3,384,065 | 5/1968 | Raymond | 125/26 |
| 3,410,259 | 11/1968 | Skiruin et al. | 125/26 |
| 3,945,151 | 3/1976 | Cook | 125/26 |
| 4,256,078 | 3/1981 | Whitty | 125/26 |
| 4,393,856 | 7/1983 | Gebhart | 125/26 |
| 4,557,246 | 12/1985 | Seeley | 125/26 |

*Primary Examiner*—Maurina T. Rachuba
*Attorney, Agent, or Firm*—Ashen Golant & Lippman

[57] ABSTRACT

An apparatus for enhancing the face of a masonry building block including a frame for supporting a conveyer belt, three cutting tools, rollers for constraining the building block and a water system for spraying the cutting tools and the building block. The cutting tools each have a rotatable horizontally disposed disk containing a plurality of synthetic diamond cutting segments. The disk is mounted to a vertically disposed shaft which in turn is mounted within a housing. There are threads on the outside of the housing which mate with a horizontal plate to allow the disk to be vertically positioned relative to the block. A locking nut is placed around the housing.

9 Claims, 3 Drawing Sheets

BUILDING BLOCK FACE ENHANCEMENT APPARATUS

BACKGROUND OF THE INVENTION

1. Field of the Invention

This invention relates generally to building blocks, and more particularly, to an improved apparatus for enhancing the faces of such blocks to improve their appearance.

2. Description of the Related Art

Building blocks are often made by mixing sand, gravel, cement and water, pouring the mixture into a mold and applying vibration and pressure. The blocks formed are then dried. These blocks, known sometimes as cinder blocks, are commonly used to build walls and building structures.

Efforts have been made to enhance the bland, dull appearance of these blocks. These efforts include roughening the faces or applying a texture during the molding step. Efforts have also been made to grind away a layer, about 1/16 of an inch to give the blocks more of the appearance of granite or marble. One such device described in U.S. Pat. No. 5,085,008 employs a rotating drum to which is adhered an abrasive for grinding the block as it passes beneath the drum; an alternative device had the block pass between parallel saw blades. The drum produces an enhanced building block face or faces, however, the device also gouges or tears at the face which tends to remove an excessive amount of the small rocks embedded in the cement of the block. This detracts from the appearance of the face and also provides numerous small recesses into which mortar may enter during the process of constructing a wall. This mortar is very difficult and time consuming to remove. The presence of mortar on the facing surface of a block further detracts from its aesthetic value by causing discolorations. The rough surfaces also tend not to reflect much light and so appear dull and lifeless.

Another device that may be used for enhancing the faces of cinder blocks is one that includes a rotating belt sander for smoothing the surfaces of the block. At least two problems exist with such a system. First, a belt sander tends to break down too rapidly causing a wide variance in the quality of the enhanced blocks and making it uneconomic. Another major problem is that the sanding operation is dry, and thus, large quantities of dust are released into the air. In many locations, allowing the dust to escape into the atmosphere is illegal. Hence, expensive dust capturing systems are required.

BRIEF SUMMARY OF THE INVENTION

The inadequacies of the related art had been resolved by the present invention which is an improved building block face enhancement apparatus. This apparatus is relatively simple and inexpensive, and environmentally safe.

The present invention relates to a face enhancing apparatus for building blocks comprising a conveyer system for transporting masonry building blocks along a predetermined path; a frame for supporting the conveyer system at a convenient height and for supporting other elements of the apparatus; a first spring biased element mounted to the frame for applying a downward force on a block being transported by the conveyer system; a plurality of cutting disks adjustably mounted to the frame for removing a predetermined amount of material from a face of a building block being transported by the conveyer system passed the disks; a housing for each of the plurality of cutting disks for supporting the disks and for providing that the disks be adjustable in a vertical direction, each of said housings have in a generally cylindrical shape with an outer surface having an external screw thread; the frame including a plate positioned in a generally horizontal plane and having an opening for each of the housings for each of the plurality of disks, each of the openings being surrounded by a threaded surface where the threads of each of the surfaces correspond to the threads of each of the housings; a lock nut for each of the housings with an inner surface having a thread corresponding to the screw thread on the housing for restraining rotation of the housing when in a locking position and for allowing rotation of the housing to provide for vertical adjustment when in a non-locking position; a second spring biased element mounted to the frame for applying lateral forces on a block being transported by the conveyer system for restraining the block when it is moved passed the cutting disks; motor means connected to each of the disks for causing the disks to rotate and connected to the conveyer system for causing the conveyer system to move the blocks; and a tube connected to the frame for directing a liquid to the regions of contact between the plurality of disks and the blocks.

A more complete understanding of the present invention and its objects, aims and advantages thereof will be gained from a consideration of the following description of the preferred embodiment read in conjunction with the accompanying drawings provided herein.

DESCRIPTION OF THE PREFERRED EMBODIMENT

Figure 1:
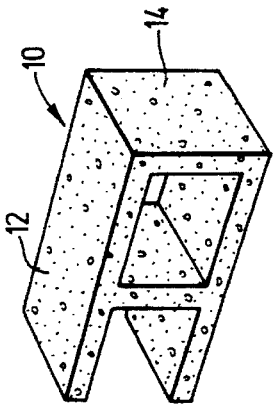
FIG. 1 is a perspective view of a typical building block whose facing surfaces are to be enhanced.

While the present invention is open to various modifications and alternative constructions, the preferred embodiment shown in the drawing will be described herein in detail. It is to be understood, however, that there is no intention to limit the invention to the particular form disclosed. On the contrary, the intention is to cover all modifications, equivalences and alternative constructions falling within the spirit and scope of the invention as expressed in the appended claims.

Building blocks are typically made from cement, sand, water and one of the following material; gravel, pumice, lava rock and cinder. The procedure includes mixing the materials, pouring the mixture into a mold, subjecting the mixture to vibration and pressure, and then drying the formed block. An example of such a block is shown in FIG. 1 and is labeled with the numeral 10. As can be seen, the block is hollow in its interior to minimize weight. The use of pumice, cinder and lava is also used with an eye to reduce weight. These materials act as a filler in a building block and as an element to which the cement can adhere. As long as a block is of sufficient strength a minimal weight makes it easier for a mason to handle the blocks during the building process.

The exposed faces or surfaces such as faces 12 and 14 of such building blocks tend to have a dull, pitted, unattractive look unless some effort is made to alter their appearances. In comparison to the building block 10, such natural materials as granite and marble are very attractive in appearance and are highly sought after as facing material for buildings. Hence, it is a major advantage of the present invention to provide an apparatus for enchancing the faces of building blocks to give a wall or building of such blocks a much improved aesthetic appearance, approaching that of granite or marble. It is also an object of the present invention to provide a block face enhancing apparatus that is rugged, efficient, economical and reliable.

Figure 2:
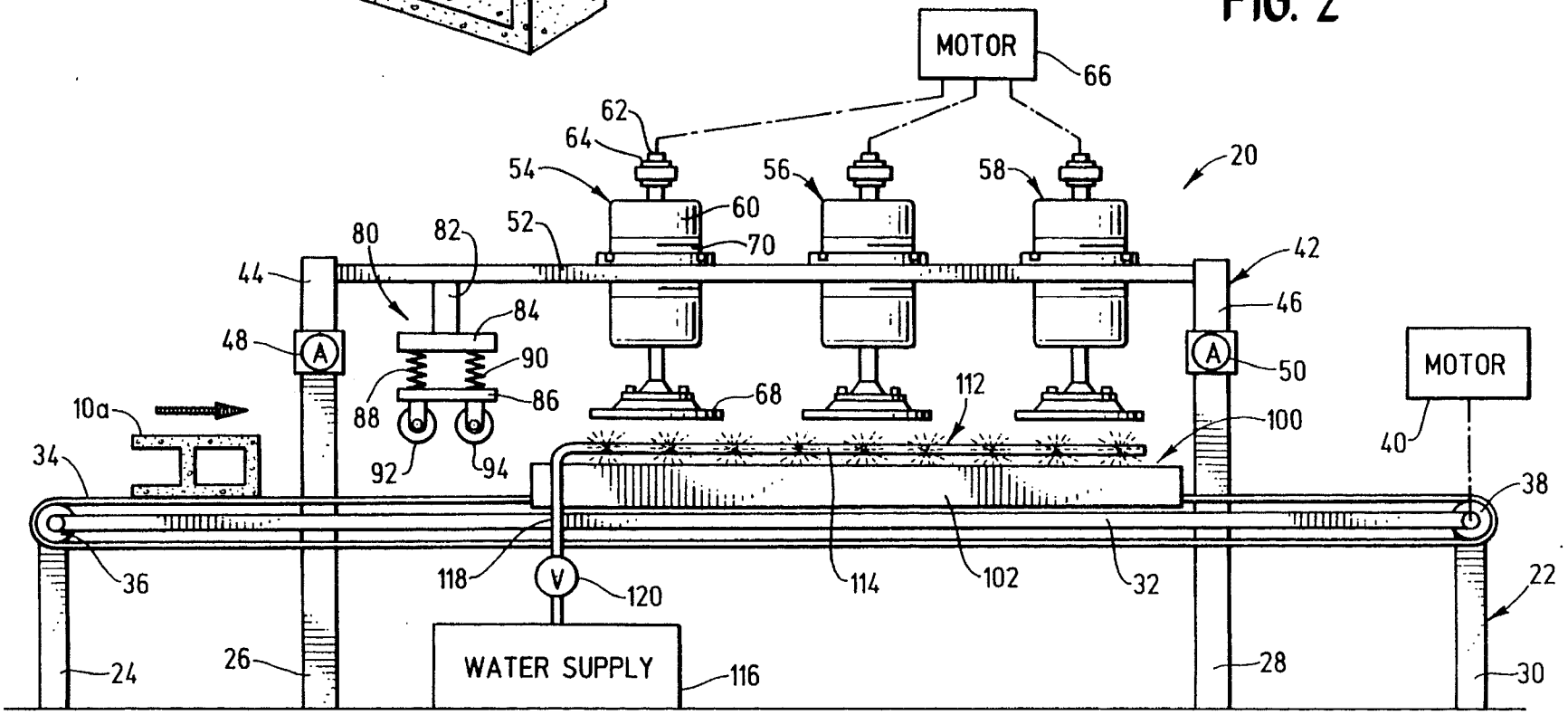
FIG. 2 is a diagrammatic elevational view of a preferred embodiment of an apparatus for enhancing the face of a building block.
Figure 4:
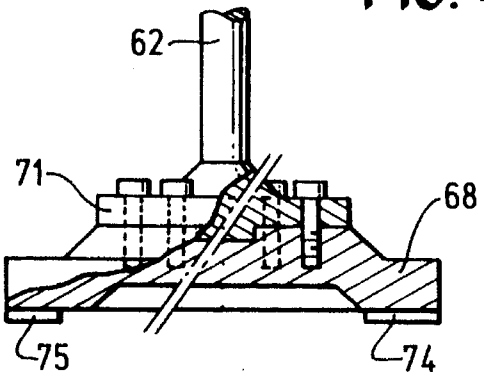
FIG. 4 is a cross-sectional elevational view taken along line 4—4 of FIG. 3.

Referring now to FIG. 2, the face enhancing apparatus 20 includes a lower frame 22 of which four legs 24, 26, 28 and 30 are shown. Attached to the legs in a horizontal plane are lateral members such as member 32. Cross beams (not shown) are also provided to strengthen the frame. The lateral members, cross-beams and the legs may be of any suitable shape such as L-shaped, channel shaped or tubular.

Mounted to the lower frame is a conveyer belt 34 rotating about sprocket wheels 36 and 38 for moving a block, such as the block 10*a*. The belt may be a chain with bars attached (also know as a slat conveyor). Attached to the wheel 38 is a drive motor 40. A suitable drive motor is made by Dayton-Morse having a ¾ horsepower rating and it may be purchased from W. W. Grainger of Tucson, Ariz.

Integral with the lower frame is an upper frame 42 having adjustable arms, such as the arms 44 and 46. The adjustment feature is symbolically shown by the letter "A" in a circle and is identified by the numerals 48 and 50. Fixed to the adjustable legs is a horizontally disposed steel plate 52. The plate has three openings through which are positioned three cutting tools, 54, 56 and 58. Each cutting tool includes a cylindrical housing such as the housing 60 which contains a rotatable shaft such as the shaft 62 mounted to bearings. A sprocket 64 may be mounted to each of the shafts which in turn is connected by a belt drive 65, FIG. 6, to a drive motor 66. A suitable belt drive is made by Woods and may be purchased from U.S. Bearings and Drives, Tucson, Ariz. A suitable motor is made by Magnetek National Coil of Tucson, Arizona. The horsepower rating should be within the range 10 to 20. At the lower end of the shaft is connected a disk 68 to which is attached a number of cutting segments as will be explained below. A portion of each of the cylindrical housings has a threaded outer surface 70 which mates with corresponding threads in the walls of the openings in the plate 52.

Figure 3:
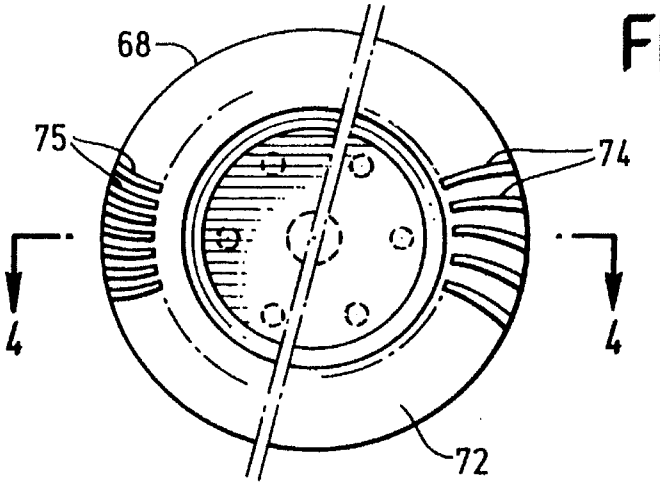
FIG. 3 is a bottom plan view of a disk containing a plurality of cutting segments showing two different styles.

Referring now to FIG. 3 there is illustrated the disk 68 having a bottom face 72 to which is mounted the cutting segments 74 along the outer portion of the disk. The disk may be made of 4130 tool steel and may range in diameter from 10 inches to 20 inches, depending on whether the cutting tool works on one or two blocks at a time. Each cutting segment is made of synthetic diamonds mixed with powdered metal alloy that is cold pressed and sintered. The pressure is applied by a 200 ton press (applying 200 tons per square inch) and sintering is at a temperature between 1400–1600 degrees F. On a 10 inch diameter disk each segment on the first disk measures about 28.16 mm in length,, about 7.92 mm in width and about 4.74 mm in height. The disk contains 36 such segments. For the second and third disks the segments are about 22.22 mm in length, 5.53 mm in width and about 2.36 mm in height. Each disk contains 66 segments. As shown in FIG. 3, the segment for the first disk is labeled 74. The segments for the second and third disk are labeled 75 and are referred to as "turbo style". The first cutting tool 54 may have segments with a $^{40}/_{50}$ grit size, the second tool 56 may have segments with a $^{170}/_{200}$ grit size and the last tool 58 may have segments with a $^{200}/_{230}$ grit size. The diamond concentration is 30. The segments may be attached to the disk by silver brazing. Such disks and cutting segments may be purchased from MK Diamond Products of Torrence, Calif. The disk is attached by screws to an arbor 71 which in turn is affixed to the shaft 62.

Figure 5:
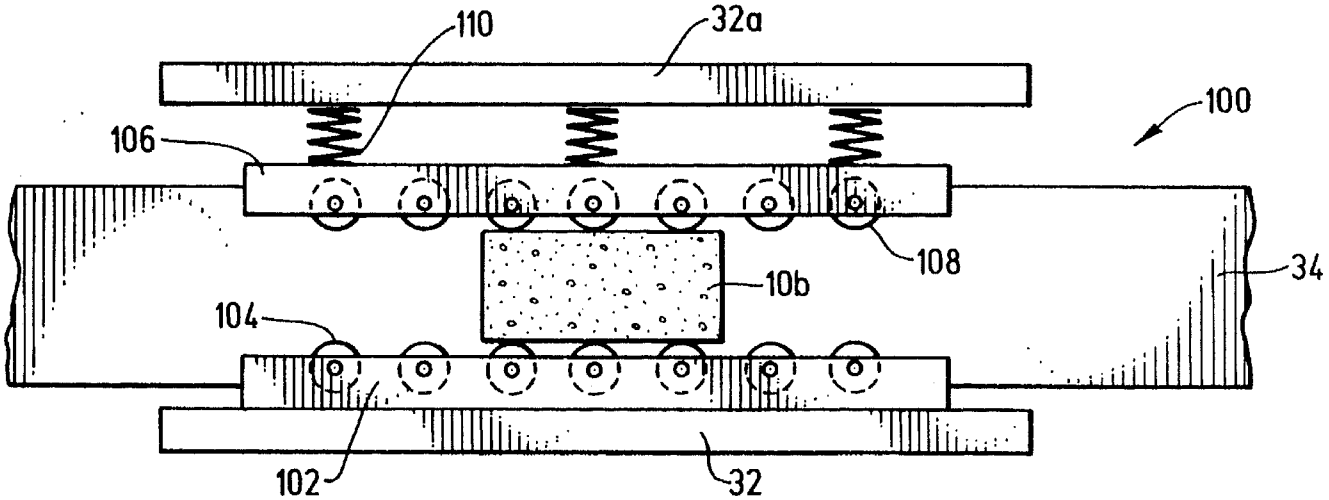
FIG. 5 is a top diagrammatic view of a portion of the apparatus shown in FIG. 2 illustrating the manner of restraining the building block.

Referring now to FIGS. 2 and 5, the restraining elements of the apparatus are illustrated. To ensure that each block is seated on the conveyer belt 34, a spring braised roller assembly 80 is mounted to the upper frame. The assembly includes a mounting bracket 82, connecting plates 84 and 86, two springs 88 and 90 mounted to the connecting plates and two rollers 92 and 94 mounted to the plate 86.

To restrain building blocks, such as the block 10*b*, on the conveyer from lateral movement, a horizontally roller assembly 100 is provided. The assembly includes a first roller support bracket 102 containing a number of rollers such as the roller 104, while on the opposite side of the conveyer 34 is a second roller bracket 106 to which is mounted a number of rollers such as the roller 108. The bracket 102 is fixed to the lateral frame element 32. The opposing bracket 106 is spring mounted such as with a spring 110 to the opposing lateral frame member 32*a*. The rollers are made of synthetic rubber and are available from W. W. Grainer of Tucson, Ariz. The springs are coiled steel having a diameter of one inch, a spring rate of 20–60 pounds and may be purchased from McMaster & Carr of Los Angeles, Calif.

Referring to FIG. 2 once again, a water spray system 112 is provided to spray the disks and segments as well as the surface of the block with water. The benefit of the spray is to cool the cutting tool and thus prolong its life. A second benefit is that the water acts to carry some material removed from the work surface back to the surface and into the openings which exist in the block. The result is a surface which has fewer pits or crevices. The water spray assembly includes a tube 114 having a number of small holes aligned opposite the cutting tools, a water supply 116 such as a city main, a tube or hose 118 and a valve 120 to control pressure.

Figure 6:
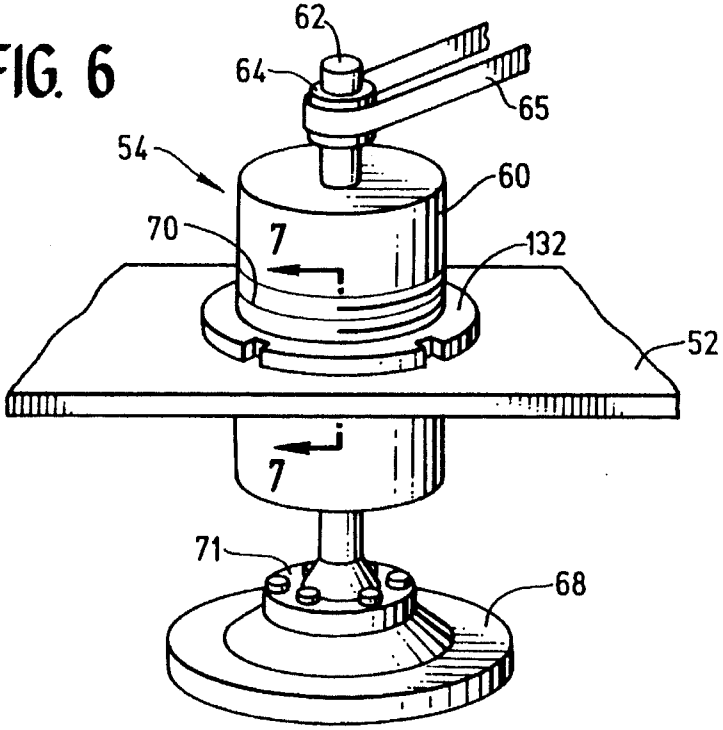
FIG. 6 is a perspective view of a cutting disk and the manner of adjusting and locking the disk in position.
Figure 7:
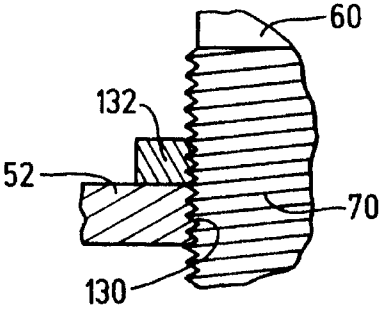
FIG. 7 is a partial enlarged view, a portion of which is in cross-section taken within the region designated 7—7 of FIG. 6.

Referring now to FIGS. 6 and 7, the mounting of the cutting tools are shown in more detail. The cutting tool 54 is shown with the shaft 62 in the housing 60. The outer diameter threads 70 are also shown, and by referring to FIG. 7 the mating threads 130 are shown in the plate 52. The use of threads allow the cutting tool to be vertically adjusted in a very minute way and in a manner which is quite simple. At the same time, the cutting tool is securely positioned relative to the frame. A lock nut 132 may be provided to restrain the cutting tool to the position in which it is placed and to provide further support to prevent any movement of the cutting disk. All of the cutting tools are consructed in the same manner.

Figure 8:
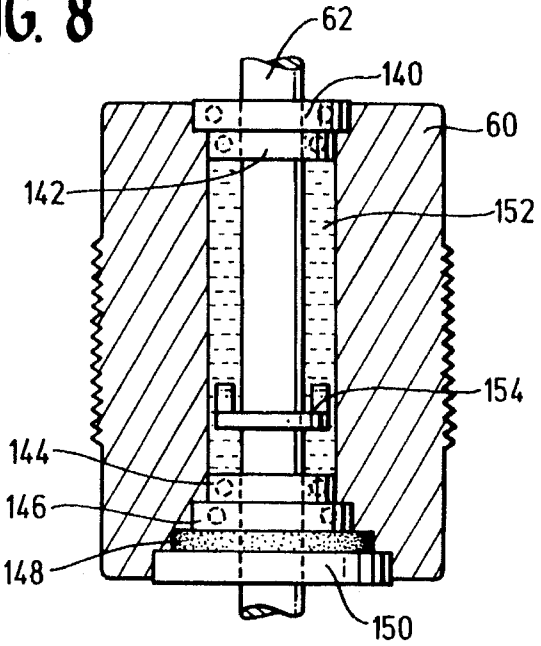
FIG. 8 is a cross-sectional elevational view of the interior of the cutting disk housing.
Figure 9:
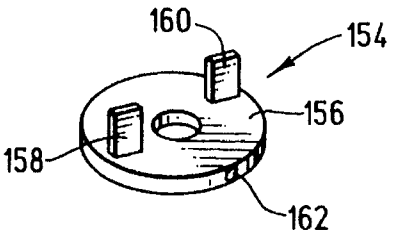
FIG. 9 is an enlarged perspective view of an oil paddle located in the interior of the cutting disk housing.

Referring now to FIG. 8, the interior of the housing is illustrated. Located centrally in the housing is the shaft 62. It is mounted in the housing by four bearings, 140, 142, 144 and 146. A seal 148 is also provided as is an end plate 150 to maintain the seal under pressure against the bearings. An interior chamber 152 exists around the shaft and forms a reservoir for lubricating oil (not shown). To circulate the lubricating oil, an oil paddle 154 is secured at the lower portion of the shaft 62 within the chamber. As best shown in FIG. 9 the oil paddle includes a mounting plate 156 and two paddle elements 158 and 160. A set screw 162 may be used to hold the oil paddle to the shaft. When the shaft rotates, the paddle elements 158, 160 spin the oil causing it to impinge upon the upper bearings 140 and 142 and thereby lubricate them. Gravity will move the oil to the lower bearings 144, 146.

In operation, a block or two blocks in parallel are placed upon the conveyer belt which moves the block or blocks relative to the cutting tools. The blocks first encounter the vertically restraining rollers 92, 94 and then the laterally restraining system 100. At the same time the block or blocks encounter the first cutting tool 54 to which is mounted relatively course cutting segments. The block or blocks then move to the second of the three cutters 56 having medium course segments. Thereafter, the block or blocks move to the cutting tool 58 which makes a fine cut.

The water spray system 112 cools the segments and the blocks, carries away most of the removed material and also leaves some of the removed material as a polishing agent or imbedded in the freshly cut surface to add to its aesthetic enhancement.

What is claimed is:

1. A face enhancing apparatus for masonry building blocks comprising:

a conveyer system for transporting masonry building blocks along a predetermined path;

a frame for supporting said conveyer system at a convenient height and for supporting other elements of the apparatus;

a first spring biased element mounted to said frame for applying a downward force on a block being transported by said conveyer system;

a plurality of cutting disks adjustably mounted to said frame for removing a predetermined amount of material from a face of a block being transported by said conveyor system passed said disks;

a housing for each of said plurality of cutting disks for supporting said disks and for providing that the disks are adjustable in a vertical direction, each of said housings having a generally cylindrical shape with an outer surface having an external screw thread;

said frame including a plate positioned in a generally horizontal plane and having an opening for each of said housings for each of said plurality of disks, each of said openings being surrounded by a threaded surface where said threads of each of said surfaces correspond to the threads of each of said housings;

a lock nut for each of said housings with an inner surface having a thread corresponding to the screw thread on the housing for restraining rotation of said housing when in a locking position and for allowing rotation of said housing to provide for vertical adjustment when in a non-locking position;

a second spring biased element mounted to said frame for applying lateral forces on a block being transported by said conveyer system for restraining said block when it is moved passed said cutting disks;

motor means connected to each of said disks for causing said disks to rotate, and connected to said conveyer system for causing said conveyer system to move said blocks; and a tube connected to said frame for directing a liquid to the regions of contact between said plurality of disks and said blocks.

2. An apparatus as claimed in claim 1 wherein:

said plate is adjustable in a vertical direction relative to the remainder of said frame to accommodate different sized blocks.

3. An apparatus as claimed in claim 2 wherein:

said second spring biased element includes a plurality of rollers that are biased to engage said blocks.

4. An apparatus as claimed in claim 3 wherein:

said first spring biased element includes a roller that is biased to engage said blocks.

5. An apparatus as claimed in claim 2 where in:

each of said disks have a plurality of cutting segments mounted near its periphery, said disks being supported to rotate about an axis perpendicular to the block facing surface to be enhanced.

6. An apparatus as claimed in claim 5 wherein:

said disks are positioned in a row so as to engage block facing surfaces in sequence, each disk downstream of the first disk having cutting segments capable of performing a finer cut.

7. An apparatus as claimed in claim 6 wherein:

said second spring biased element includes a plurality of rollers that are biased to engage said blocks.

8. An apparatus as claimed in claim 7 wherein:

said first spring biased element includes a roller that is biased to engage said blocks.

9. An apparatus as claimed in claim 8 wherein:

at least some of said cutting elements have an arcuate shape.

* * * * *